US012258687B2

(12) United States Patent
Cao et al.

(10) Patent No.: US 12,258,687 B2
(45) Date of Patent: Mar. 25, 2025

(54) METHOD FOR MANUFACTURING FLAME-RETARDANT BULKY FIBER WITHOUT FLAME RETARDANT ON FULLY-DRAWN YARN (FDY) MACHINE

(71) Applicant: KUNSHAN YIJIA JU TEXTILE CO., LTD., Kunshan (CN)

(72) Inventors: Shunlin Cao, Kunshan (CN); Qionghua Cai, Kunshan (CN); Guochuang Zhang, Kunshan (CN); Xuewen Lou, Kunshan (CN)

(73) Assignee: KUNSHAN YIJIA JU TEXTILE CO., LTD., Kunshan (CN)

( * ) Notice: Subject to any disclaimer, the term of this patent is extended or adjusted under 35 U.S.C. 154(b) by 576 days.

(21) Appl. No.: 17/602,745

(22) PCT Filed: Dec. 25, 2019

(86) PCT No.: PCT/CN2019/128277
§ 371 (c)(1),
(2) Date: Oct. 9, 2021

(87) PCT Pub. No.: WO2020/207056
PCT Pub. Date: Oct. 15, 2020

(65) Prior Publication Data

US 2022/0195640 A1 Jun. 23, 2022

(30) Foreign Application Priority Data

Apr. 9, 2019 (CN) ..... 201910282234.2

(51) Int. Cl.
*D02G 3/44* (2006.01)
*D01D 5/16* (2006.01)
*D02G 3/24* (2006.01)

(52) U.S. Cl.
CPC ..... *D02G 3/443* (2013.01); *D01D 5/16* (2013.01); *D02G 3/24* (2013.01); *D10B 2331/04* (2013.01)

(58) Field of Classification Search
CPC ..... D02G 3/24; D10B 2331/04
See application file for complete search history.

(56) References Cited

U.S. PATENT DOCUMENTS 3,852,946 A * 12/1974 Smith ..... D02G 1/04 57/247
4,133,087 A * 1/1979 Li ..... D02G 1/122 28/267

(Continued)

FOREIGN PATENT DOCUMENTS

CN 1340113 A 3/2002
CN 101054733 A 10/2007

(Continued)

OTHER PUBLICATIONS

Machine English translation of CN-101054733-B, Accessed Jan. 5, 2024 (Year: 2010).*

*Primary Examiner* — Elizabeth M Imani
(74) *Attorney, Agent, or Firm* — Bayramoglu Law Offices LLC

(57) ABSTRACT

A method for manufacturing a flame-retardant bulky fiber without a flame retardant on a fully-drawn yarn (FDY) machine is provided. The flame-retardant bulky fiber is formed by winding a plurality of spiral yarns arranged in the same direction; and the yarns are polyester yarns with a fineness of 0.52 DPF to 80 DPF. The method includes the following steps: slicing and drying a polyester masterbatch; spinning through a spinning die, and cooling by side blowing; cooling and oiling; drawing by a first hot roller; drawing and shaping by a second hot roller; and winding. The present disclosure can manufacture a flame-retardant bulky fiber on (Continued)

an FDY machine, which has the same effect as drawn textured yarn (DTY) manufactured by a texturing machine. Moreover, without being added with any chemical flame retardant, the flame-retardant bulky fiber of the present disclosure can reach the flame-retardant standard of home textiles.

12 Claims, 1 Drawing Sheet

(56) References Cited

U.S. PATENT DOCUMENTS

| | | | | |
|---|---|---|---|---|
| 6,447,703 | B1 | 9/2002 | Waddington et al. | |
| 2001/0038159 | A1* | 11/2001 | Maranca ..... | D02G 1/122 28/258 |
| 2007/0243379 | A1 | 10/2007 | Jung et al. | |
| 2008/0157425 | A1 | 7/2008 | Rodgers et al. | |

FOREIGN PATENT DOCUMENTS

| | | | |
|---|---|---|---|
| CN | 101338455 | A | 1/2009 |
| CN | 101676451 | A | 3/2010 |
| CN | 101812737 | A | 8/2010 |
| CN | 102605499 | A | 7/2012 |
| CN | 102660819 | A | 9/2012 |
| CN | 103243400 | A | 8/2013 |
| CN | 109082722 | A | 12/2018 |
| CN | 110004553 | A | 7/2019 |
| CN | 209854312 | U | 12/2019 |
| JP | 2008106410 | A | 5/2008 |
| KR | 100760799 | B1 | 10/2007 |

* cited by examiner

METHOD FOR MANUFACTURING FLAME-RETARDANT BULKY FIBER WITHOUT FLAME RETARDANT ON FULLY-DRAWN YARN (FDY) MACHINE

CROSS REFERENCE TO THE RELATED APPLICATIONS

This application is the national phase entry of International Application No. PCT/CN2019/128277, filed on Dec. 25, 2019, which is based upon and claims priority to Chinese Patent Application No. 201910282234.2, filed on Apr. 9, 2019, the entire contents of which are incorporated herein by reference.

TECHNICAL FIELD

The present disclosure relates to a method for manufacturing a flame-retardant bulky fiber without a flame retardant on a fully-drawn yarn (FDY) machine.

BACKGROUND

Polyester (PET) fiber is widely used in home textiles and other fields. In addition to pure polyester fiber products, there are many products that are obtained by blending or interweaving polyester fibers with other textile fibers, so these products can cover the shortcomings of pure polyester fiber fabrics.

Oxygen index (OI), also known as limiting oxygen index (LOI), refers to the minimum oxygen amount required for combustion of an item. The use environment of a home textile product requires an OI of the home textile product to reach 26% or above. However, an OI of polyester fiber without flame-retardant treatment is typically less than 21%. Therefore, when the polyester fiber is industrially manufactured, the polyester fibers need to be subjected to flame-retardant treatment.

Existing flame-retardant treatment technologies mainly include the copolymerization modification method and the post-finishing method. The copolymerization modification method includes: using a chemical flame retardant in the polymerization of PET to form an intramolecular flame-retardant copolyester, and melt-spinning the intramolecular flame-retardant copolyester to obtain polyester fibers with flame retardance. The post-finishing includes: immersing polyester fibers in a finishing solution with a flame retardant to make the flame retardant adhere to a surface of the polyester fibers.

Existing chemical flame retardants can be divided into organic flame retardants, inorganic flame retardants, or divided into halogen-containing flame retardants, and halogen-free flame retardants. The organic flame retardants representatively refer to some flame retardants based on bromine, nitrogen, or red phosphorus or a compound thereof, and flame retardant synergists based on triazine and a derivative thereof or tripolycyanamide. The inorganic flame retardants mainly refer to flame retardants or flame retardant synergists based on antimony compound, hydroxyl compound, hydroxide, silicon, or graphite (such as graphene). Generally, organic flame retardants have a high affinity for plastic products. Bromine-containing flame retardants have an absolute advantage among organic flame retardant systems. Phosphorus-containing flame retardants are widely used in synthetic fiber products. In production practice, composite phosphorus/magnesium, phosphorus/aluminum, and phosphorus/graphite flame retardants and other halogen-free flame retardants can greatly reduce the consumption of flame retardants.

The treatment methods using the above-mentioned flame-retardants have shortcomings of the intervention and use of a chemical flame retardant. As a result, the polyester fiber fabrics are not healthy, safe and environmentally friendly enough, which is particularly sensitive in the home textile industry. In addition, a cost of a chemical flame retardant accounts for a relatively high proportion in a cost of a home textile product. Therefore, it is an aspirational goal in the industry to manufacture a home textile polyester fiber without a chemical flame retardant.

Home textile polyester yarns can be divided into spun yarns, drawn yarns, and textured yarns.

Pre-oriented yarns (POYs) refer to incompletely-drawn fiber yarns that are obtained by high-speed spinning and have an orientation degree between the orientation degree of undrawn yarns (UDYs) and the orientation degree of drawn yarns. POYs are a kind of spun yarns and cannot be directly used in fabrics.

FDYs are fiber yarns produced by one-step spin-drawing. Specifically, a set of hot rollers are used in a POY spinning process, and yarns are drawn and wound by the set of hot rollers after being oiled to obtain FDYs. FDYs are a kind of drawn yarns and have the characteristics of high orientation degree and medium crystallinity. "Orientation" refers to the release of internal stress of the original yarn, that is, a shape of a fully-oriented (fully-drawn) yarn can no longer be changed.

Drawn textured yarns (DTYs) are a kind of textured yarns. DTYs with high crimpness and bulkiness are formed by drawing and false-twisting spun yarns such as POYs, which takes advantage of the thermoplasticity of fibers. DTYs are also referred to as bulky yarns or elastic yarns. With regard to the appearance of fibers, POY fibers and FDY fibers are straight, and DTY fibers are crimped.

Bulky yarns/elastic yarns produced by an existing DTY process have the advantages of prominent resilience, heat resistance, light resistance, strong corrosion resistance, simple washing and fast drying, and thus are suitable for making garment fabrics, bedclothes, decorative articles, and the like. However, DTYs also have shortcomings of easy pilling and a low gloss, which cannot satisfy the user due to the mentioned negative performance of DTY. FDY fibers produced by existing processes have a silky gloss and are not prone to pilling, but all are low-elastic yarns/non-bulky yarns. Therefore, FDYs cannot replace the existing DTY bulky yarns. At present, only some specially-treated nylon fibers can achieve the above composite use, and thus how to find an alternative polyester fiber is a problem to be solved in the industry.

SUMMARY

The present disclosure is intended to overcome the above-mentioned shortcomings in the prior art and provide a method for manufacturing a flame-retardant bulky fiber without a flame retardant on an FDY machine. The flame-retardant bulky fiber, also known as bulky yarn, is produced by adjusting a manufacturing process on an FDY machine, which has different stress quantification in linear orientation and can also have improved crystallinity. A crystallinity of a yarn has a great impact on the thermal and optical properties of the yarn, and thus increasing a crystallinity of a yarn through process adjustment can improve the flame retardance of the yarn. In addition, the produced flame-retardant bulky fiber also has a different structure from the traditional bulky yarn, which is formed by winding a plurality of spiral yarns arranged in the same direction. Therefore, without being added with any chemical flame retardant, the flame-retardant bulky fiber of the present disclosure can reach the flame-retardant standard of home textiles and shows an LOI of 26% or more. When exposed to high temperature, the flame-retardant bulky fiber will shrink and condense rapidly and will not melt. Textiles using the flame-retardant bulky fiber have the characteristics of high brightness, smoothness, softness, prominent bulkiness, excellent elasticity, and no pilling.

The objective of the present disclosure is achieved by the following technical solutions.

In a first aspect, the present disclosure relates to a flame-retardant bulky fiber that is formed by winding a plurality of spiral yarns arranged in the same direction; and the yarns are polyester yarns with a fineness of 0.52 DPF to 80 DPF.

Preferably, there may be 18 to 576 yarns for the winding.

Preferably, the flame-retardant bulky fiber may not include a flame retardant.

Preferably, the flame-retardant bulky fiber may have a crystallinity of 40% to 52%. The crystallinity is measured by a density-gradient test.

Preferably, the flame-retardant bulky fiber may have an LOI of 26% or more.

Preferably, the flame-retardant bulky fiber may be manufactured by one-step spin-drawing on an FDY machine at a drawing ratio of 1.6 to 2.6.

In a second aspect, the present disclosure relates to a method for manufacturing a flame-retardant bulky fiber without a flame retardant on an FDY machine, including the following steps:

S1. slicing and drying a polyester masterbatch;

S2. spinning through a spinning die, and cooling by side blowing;

S3. cooling and oiling;

S4. drawing by a first hot roller, where the first hot roller may have a temperature of 80° C. to 88° C., and a speed of 1,850 m/min to 1,980 m/min and preferably 1,924 m/min;

S5. drawing and shaping by a second hot roller, wherein the second hot roller may have a temperature 30° C. to 50° C. higher than the temperature of the first hot roller, and a speed of 3,600 m/min to 5,600 m/min and preferably 4,040 m/min; and S6. winding.

Preferably, a temperature difference between the second hot roller and the first hot roller may be 30° C. to 35° C.

Preferably, in S1, the drying may be conducted at 150° C. to 170° C. for 7 h to 10 h.

Preferably, in S2, the cooling by side blowing may be conducted at a wind speed controlled at 0.55 m/s to 0.7 m/s and a wind temperature controlled at 16° C. to 25° C.

Preferably, in step S3, the oiling may be conducted at an oiling rate of 0.8% to 1.5%.

Preferably, a ratio of the speed of the second hot roller to the speed of the first hot roller may be (1.6-2.6):1, and the ratio is the drawing ratio, which may preferably be (2-2.1):1.

In a third aspect, the present disclosure relates to use of the flame-retardant bulky fiber in the manufacturing of a home textile.

Preferably, the home textile may include carpet, garment, and the like.

Compared with the prior art, the present disclosure has the following beneficial effects:

(1) The present disclosure can manufacture a flame-retardant bulky fiber on an FDY machine, which has the same effect as DTY manufactured by a texturing machine.

(2) Without being added with any chemical flame retardant, the flame-retardant bulky fiber of the present disclosure can reach the flame-retardant standard of home textiles.

(3) The flame-retardant bulky fiber of the present disclosure has a different structure from the traditional bulky yarn, which is formed by winding a plurality of spiral yarns arranged in the same direction. This structure makes the flame-retardant bulky fiber have the characteristics of high brightness, smoothness, softness, and no pilling in addition to prominent bulkiness and elasticity.

(4) The flame-retardant bulky fiber also has the characteristics of high brightness, no pilling, smoothness, and softness. Fabrics using the flame-retardant bulky fiber have prominent bulkiness, elasticity, and flame retardance.

BRIEF DESCRIPTION OF THE DRAWINGS

Other features, objectives, and advantages of the present disclosure will become more apparent by reading the detailed description of non-limiting examples with reference to the following accompanying drawings.

DETAILED DESCRIPTION OF THE EMBODIMENTS

The present disclosure is described in detail below with reference to examples. The following examples will help those skilled in the art to further understand the present disclosure, but do not limit the present disclosure in any way. It should be noted that those of ordinary skill in the art can further make several modifications and improvements without departing from the idea of the present disclosure. These all fall within the protection scope of the present disclosure.

Figure 1:
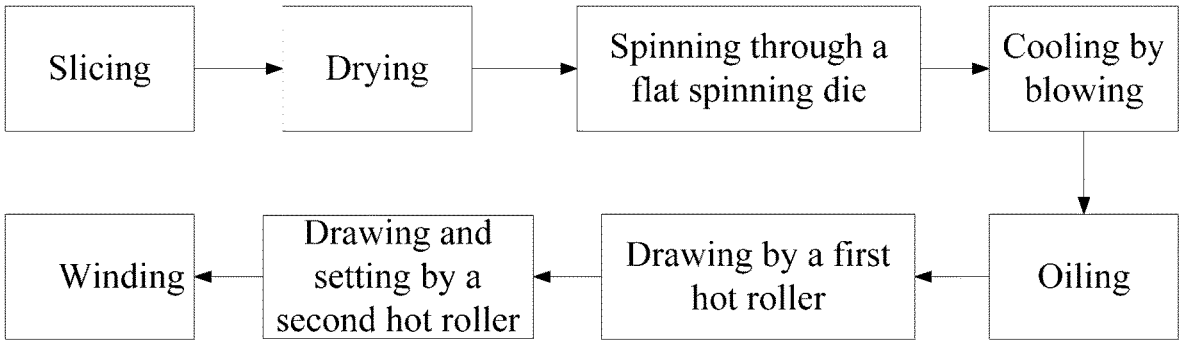
FIG. 1 is a schematic diagram of a manufacturing process of the flame-retardant bulky fiber of the present disclosure.

Example 1 Manufacturing of Flame-Retardant Bulky Polyester Fiber 300 Dtex/96F A method for manufacturing a flame-retardant bulky fiber without a flame retardant on an FDY machine was provided in this example. The manufacturing process was shown in FIG. 1 and included the following steps:

(1) Slicing: A polyester masterbatch was sliced.

(2) Drying: Polyester masterbatch slices were dried at 165° C. for 9 h.

(3) Spinning through a spinning die: The FDY machine adopted a Φ105 spinning screw and a spinning die Φ90-48-*0.8 (0.14*0.24). As a flat spinning die with a linear cross section is conducive to the linear deformation of fibers after being drawn at a high strength, a flat spinning die was used for spinning in this example. When the spinning was conducted, temperatures of a first zone, a second zone, a third zone, a fourth zone, and a fifth zone of the Φ105 spinning screw were controlled at 275° C., 281° C., 286° C., 286° C., and 283° C., respectively. As a spinning speed should be controlled at 3,600 r/min to 4,000 r/min, which is also a factor to determine a drawing ratio, a spinning speed of 4,000 r/min was selected in this example.

(4) Cooling by blowing: After the spinning was conducted through the spinning die, obtained fibers were cooled by side blowing. During the side blowing, a wind temperature should be controlled at 16° C. to 25° C. and preferably at 20° C. to 22° C. A wind speed was controlled at 0.6 m/s and a wind temperature was controlled at 21° C. in this example. The cooling method of side blowing and the appropriate wind speed and wind temperature are some of the key factors to realize the manufacturing of the flame-retardant bulky fiber without a flame retardant on an FDY machine.

(5) Oiling: The fibers were oiled by an oiler at a rotational speed of 30 r/min and an oiling rate of 0.8% to 1.5%.

(6) Rolling by a first hot roller: A temperature of the first hot roller was set to 82° C., and a speed VGR1 of the first hot roller was set to 1,924 m/min.

(7) Rolling by a second hot roller: A temperature of the second hot roller was set to 116° C., and a speed VGR2 of the second hot roller was set to 4,040 m/min.

(8) Winding: A winding speed was set to 4,000 r/min.

In the above manufacturing process, a drawing stage is the key to the linear deformation. The finished product FDY is obtained by two-stage drawing (including spinning die drawing between the hot roller GR and the spinning die and roller drawing between the first hot roller and the second hot roller), setting, and winding. The drawing ratio of the drawing in the present disclosure refers to a speed ratio of the first hot roller to the second hot roller (the hot rollers have different rotational speeds due to different diameters, which are generally expressed as a linear speed (m/min)).

Figure 2A:
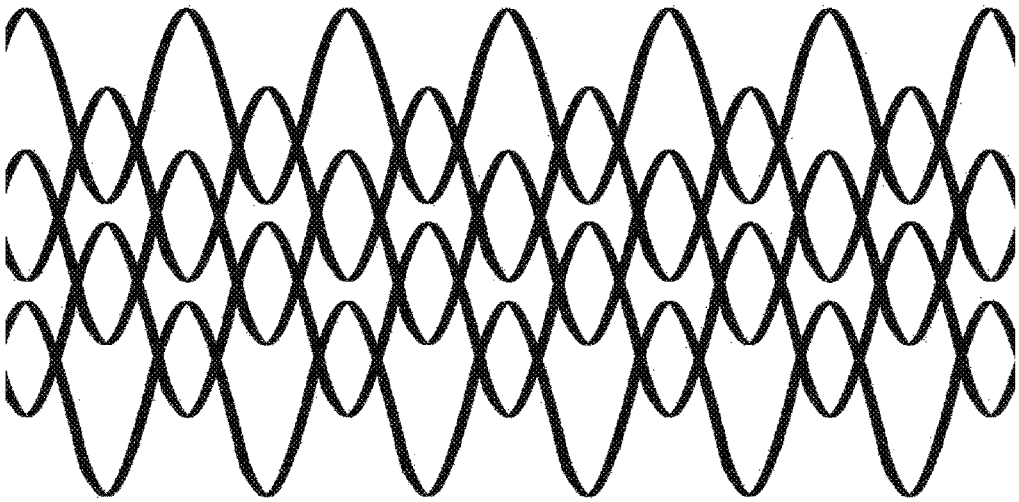
FIG. 2A is a schematic diagram of a bundle structure of the flame-retardant bulky fiber of the present disclosure.
Figure 2B:
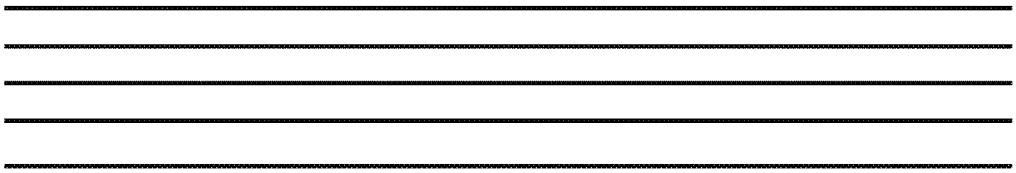
FIG. 2B is a schematic diagram of a bundle structure of the ordinary FDY fiber.

Keys for the manufacturing of a flame-retardant bulky fiber without a flame retardant on an FDY machine in the present disclosure include: 1) controlling a drawing ratio at 1.6 to 2.6; 2) controlling a temperature of the first hot roller at 80° C. to 88° C.; and 3) controlling a temperature difference (referring to a value by which the temperature of the second hot roller is higher than the temperature of the first hot roller) at 30° C. to 50° C. A structural diagram of the manufactured flame-retardant bulky fiber without a flame retardant is shown in FIG. 2 (*a*), which is completely different from that of the ordinary FDY fiber (FIG. 2 (*b*)). The flame-retardant bulky fiber of the present disclosure is formed by winding a plurality of spiral yarns arranged in the same direction (the yarns can be polyester yarns with a fineness of 0.52 DPF to 80 DPF). The number of wound yarns is actually determined by the number of holes in the spinning die, which can be 18 to 576.

A crystallinity is used to indicate a proportion of crystalline regions in a polymer. A crystallinity of a polymer varies widely, generally from 30% to 85%. For the same material, the higher the crystallinity, the higher the melting point. Crystallization is an orderly arrangement of molecular chains, and at a melting point, all molecular assembly structures are destroyed to form molecular chains. Generally, the higher the crystallinity, the more regular the arrangement of molecular chains. Therefore, at a high crystallinity, a high temperature is required to destroy the molecular assembly structures, resulting in a high melting point. At present, common methods for testing crystallinity include density-gradient test, X-ray diffraction (XRD), differential scanning calorimetry (DSC), infrared spectrometry, hydrolysis analysis, formylation analysis, deuterium exchange analysis, and the like. The present disclosure used the density-gradient test to test the crystallinity of the flame-retardant bulky fiber. In order to verify the importance of the temperatures of the hot roller and the temperature difference between the hot rollers for the manufacturing of the flame-retardant bulky fiber without a flame retardant on the FDY machine, the temperatures of and the temperature difference between the hot rollers were adjusted on the basis of the aforementioned operating parameters in this example. Crystallinity results of the manufactured flame-retardant bulky fibers were shown in Table 1:

TABLE 1

Influence of the temperatures of and the temperature difference between the hot rollers on crystallinity

| Fiber variety | Temperature of the first hot roller/° C. | Temperature of the second hot roller/° C. | Temperature difference (° C.) | Crystallinity obtained by density-gradient test/% |
|---|---|---|---|---|
| Flame-retardant bulky fiber 300 dtex/96 F. | 70 | 100 | 30 | 19.6576 |
| | 70 | 120 | 50 | 28.5565 |
| | 75 | 120 | 45 | 27.2617 |
| | 80 | 105 | 25 | 24.6349 |
| | 80 | 110 | 30 | 40.0478 |
| | 80 | 120 | 40 | 45.0362 |
| | 82 | 116 | 34 | 46.1824 |
| | 85 | 130 | 45 | 45.3785 |
| | 88 | 138 | 50 | 44.5013 |
| | 90 | 130 | 40 | 29.3470 |

In order to further verify the importance of the drawing ratio for the manufacturing of the flame-retardant bulky fiber without a flame retardant on the FDY machine, the drawing ratio was adjusted on the basis of the aforementioned operating parameters in this example, which was specifically as follows: 1) a speed VGR1 of the first hot roller was set to 1,924 m/min and a speed VGR2 of the second hot roller was set to 2,308 m/min, in which case, a corresponding drawing ratio was 1.2; and 2) a speed VGR1 of the first hot roller was set to 1,910 m/min and a speed VGR2 of the second hot roller was set to 9,550 m/min, in which case, a corresponding drawing ratio was 3.5. In the case where a drawing ratio was 1.2, the manufactured fiber did not have the flame retardant effect; and in the case where a drawing ratio was 3.5, the manufactured fiber did not have both the bulky effect and the structure shown in FIG. 2 (*a*). The fibers obtained in the above two cases were quite different from the flame-retardant bulky fiber of the present disclosure. Further, in this example, the drawing ratio was further adjusted on the basis of the aforementioned operating parameters, and it was found that the flame-retardant bulky fiber of the present disclosure could be obtained when the drawing ratio was between 1.6 and 2.6.

Example 2 Manufacturing of Flame-Retardant Bulky Polyester Fiber 240 Dtex/48F A method for manufacturing a flame-retardant bulky fiber without a flame retardant on an FDY machine was provided in this example. The manufacturing process was shown in FIG. 1 and included the following steps:

(1) Slicing: A polyester masterbatch was sliced.

(2) Drying: Polyester masterbatch slices were dried at 150° C. for 8 h.

(3) Spinning through a spinning die: The FDY machine adopted a Φ120 spinning screw and a spinning die Φ90-48-*0.8 (0.14*0.24). A flat spinning die was also used for spinning in this example. When the spinning was conducted, temperatures of a first zone, a second zone, a third zone, a fourth zone, and a fifth zone of the Φ120 spinning screw were controlled at 263° C., 267° C., 272° C., 274° C., and 276° C., respectively. A spinning speed was controlled at 3,600 r/min in this example.

(4) Cooling by blowing: After the spinning was conducted through the spinning die, obtained fibers were cooled by side blowing at a wind speed controlled at 0.65 m/s and a wind temperature controlled at 20° C.

(5) Oiling: The fibers were oiled by an oiler at a rotational speed of 30 r/min and an oiling rate of 1.0%.

(6) Rolling by a first hot roller: A temperature of the first hot roller was set to 85° C., and a speed VGR1 of the first hot roller was set to 1,924 m/min.

(7) Rolling by a second hot roller: A temperature of the second hot roller was set to 130° C., and a speed VGR2 of the second hot roller was set to 3,078 m/min.

(8) Winding: A winding speed was set to 4,000 r/min.

A structural diagram of the manufactured flame-retardant bulky fiber without a flame retardant is shown in FIG. 2 (*a*), which is formed by winding a plurality of spiral yarns arranged in the same direction. Similarly, a crystallinity of the flame-retardant bulky fiber in this example was determined by a density-gradient test, which was 48.3764%, indicating that the flame-retardant bulky fiber without a flame retardant has prominent flame retardance.

Example 3 Manufacturing of Flame-Retardant Bulky Polyester Fiber 300 Dtex/96F A method for manufacturing a flame-retardant bulky fiber without a flame retardant on an FDY machine was provided in this example. The manufacturing process was shown in FIG. 1 and included the following steps:

(1) Slicing: A polyester masterbatch was sliced.

(2) Drying: Polyester masterbatch slices were dried at 165° C. for 9 h.

(3) Spinning through a spinning die: The FDY machine adopted a Φ105 spinning screw and a spinning die Φ90-48-*0.8 (0.14*0.24). As a flat spinning die with a linear cross section is conducive to the linear deformation of fibers after being drawn at a high strength, a flat spinning die was used for spinning in this example. When the spinning was conducted, temperatures of a first zone, a second zone, a third zone, a fourth zone, and a fifth zone of the Φ105 spinning screw were controlled at 275° C., 281° C., 286° C., 286° C., and 283° C., respectively. A spinning speed was controlled at 3,850 r/min.

(4) Cooling by blowing: After the spinning was conducted through the spinning die, obtained fibers were cooled by side blowing at a wind speed controlled at 0.65 m/s and a wind temperature controlled at 23° C. The cooling method of side blowing and the appropriate wind speed and wind temperature are some of the key factors to realize the manufacturing of the flame-retardant bulky fiber without a flame retardant on an FDY machine.

(5) Oiling: The fibers were oiled by an oiler at a rotational speed of 30 r/min and an oiling rate of 1.2%.

(6) Rolling by a first hot roller: A temperature of the first hot roller was set to 82° C., and a speed VGR1 of the first hot roller was set to 1,924 m/min.

(7) Rolling by a second hot roller: A temperature of the second hot roller was set to 116° C., and a speed VGR2 of the second hot roller was set to 5,002 m/min.

(8) Winding: A winding speed was set to 4,500 r/min.

A structural diagram of the manufactured flame-retardant bulky fiber without a flame retardant is also shown in FIG. 2 (*a*), which is formed by winding a plurality of spiral yarns arranged in the same direction. Similarly, a crystallinity of the flame-retardant bulky fiber in this example was determined by a density-gradient test, which was 51.0692%, indicating that the flame-retardant bulky fiber without a flame retardant has prominent flame retardance.

Furthermore, the flame-retardant bulky fibers without a flame retardant manufactured in Examples 1, 2, and 3 were tested according to the American Home Textile Flame Retardant Standard ASTM 16 CFR 1630, and it was found that the fiber products of the present disclosure can meet the flame retardant standard requirements without any flame-retardant treatment.

Example 4 Use of Flame-Retardant Bulky Polyester Fibers

The flame-retardant bulky fiber without a flame retardant manufactured by the present disclosure can be used in the manufacturing of garments, carpets, and other home textiles. Use of the flame-retardant bulky fiber without a flame retardant manufactured in Example 1 in a carpet was provided in this example, including the following steps:

1) the flame-retardant bulky fiber was used as a main material to weave a carpet surface;

2) a substrate was prepared; and 3) the carpet surface was adhered, fitted, or stitched on the substrate to obtain the carpet.

In summary, the present disclosure can manufacture a flame-retardant bulky fiber on an FDY machine, which has the same effect as DTY manufactured by a texturing machine. Moreover, without being added with any chemical flame retardant, the flame-retardant bulky fiber of the present disclosure can reach the flame-retardant standard of home textiles. The flame-retardant bulky fiber also has the characteristics of high brightness, no pilling, smoothness, and softness. Fabrics using the flame-retardant bulky fiber have prominent bulkiness, elasticity, and flame retardance.

The specific examples of the present disclosure are described above. It should be understood that the present disclosure is not limited to the above specific implementations, and a person skilled in the art can make various variations or modifications within the scope of the claims without affecting the essence of the present disclosure.

What is claimed is:

1. A flame-retardant bulky fiber, wherein the flame-retardant bulky fiber is formed by winding a plurality of spiral yarns arranged in the same direction; and the plurality of spiral yarns are polyester yarns with a fineness of 0.52 DPF to 80 DPF, the flame-retardant bulky fiber is manufactured by one-step spin-drawing on an FDY machine at a drawing ratio of 1.6 to 2.6, the one-step spin-drawing is performed by a first hot roller and a second hot roller, the first hot roller has a temperature of 80° C. to 88° C., and the second hot roller has a temperature 30° C. to 50° C. higher than the temperature of the first hot roller; the flame-retardant bulky fiber has a limiting oxygen index (LOI) of 26% or more; the flame-retardant bulky fiber does not comprise a flame retardant.

2. The flame-retardant bulky fiber according to claim 1, comprising 18 to 576 yarns for the winding.

3. A method for manufacturing a flame-retardant bulky fiber on an FDY machine, wherein the flame-retardant bulky fiber is formed by winding a plurality of spiral yarns arranged in the same direction; and the plurality of spiral yarns are polyester yarns with a fineness of 0.52 DPF to 80 DPF, the flame-retardant bulky fiber is manufactured by one-step spin-drawing on the FDY machine at a drawing ratio of 1.6 to 2.6, the one-step spin-drawing is performed by a first hot roller and a second hot roller, the first hot roller has a temperature of 80° C. to 88° C., and the second hot roller has a temperature 30° C. to 50° C. higher than the temperature of the first hot roller; the flame-retardant bulky fiber has a limiting oxygen index (LOI) of 26% or more; the flame-retardant bulky fiber does not comprise a flame retardant; and the method comprises the following steps:

S1: slicing and drying a polyester masterbatch;

S2: spinning through a spinning die, and then cooling by side blowing;

S3: cooling and oiling;

S4: drawing by the first hot roller, wherein the first hot roller has the temperature of 80° C. to 88° C. and a speed of 1,850 m/min to 1,980 m/min;

S5: drawing and shaping by the second hot roller, wherein the second hot roller has the temperature 30° C. to 50° C. higher than the temperature of the first hot roller and a speed of 3,600 m/min to 5,600 m/min; and S6: winding.

4. The method according to claim 3, wherein in S1, the drying is conducted at 150° C. to 170° C. for 7 h to 10 h.

5. The method according to claim 3, wherein in S2, the cooling by side blowing is conducted at a wind speed controlled at 0.55 m/s to 0.7 m/s and a wind temperature controlled at 16° C. to 25° C.

6. The method according to claim 3, wherein in step S3, the oiling is conducted at an oiling rate of 0.8% to 1.5%.

7. The method according to claim 3, wherein a ratio of the speed of the second hot roller to the speed of the first hot roller is (1.6-2.6):1.

8. A method of using a flame-retardant bulky fiber, wherein the flame-retardant bulky fiber is formed by winding a plurality of spiral yarns arranged in the same direction; and the plurality of spiral yarns are polyester yarns with a fineness of 0.52 DPF to 80 DPF, the flame-retardant bulky fiber is manufactured by one-step spin-drawing on the FDY machine at a drawing ratio of 1.6 to 2.6, the one-step spin-drawing is performed by a first hot roller and a second hot roller, the first hot roller has a temperature of 80° C. to 88° C., and the second hot roller has a temperature 30° C. to 50° C. higher than the temperature of the first hot roller; the flame-retardant bulky fiber has a limiting oxygen index (LOI) of 26% or more; the flame-retardant bulky fiber does not comprise a flame retardant; a home textile is manufactured by using the flame-retardant bulky fiber.

9. The method according to claim 3, wherein the flame-retardant bulky fiber comprises 18 to 576 yarns for the winding.

10. The method according to claim 8, wherein the flame-retardant bulky fiber comprises 18 to 576 yarns for the winding.

11. The flame-retardant bulky fiber according to claim 1, wherein the flame-retardant bulky fiber has a crystallinity of 30% to 85%.

12. The flame-retardant bulky fiber according to claim 1, wherein the flame-retardant bulky fiber has a crystallinity of 40.0478% to 46.1824%.

* * * * *